US011381917B2

(12) United States Patent
Zhan et al.

(10) Patent No.: US 11,381,917 B2
(45) Date of Patent: Jul. 5, 2022

(54) VIBRATION DIAPHRAGM IN MEMS MICROPHONE AND MEMS MICROPHONE

(71) Applicant: Goertek Inc., Shandong (CN)

(72) Inventors: Junkai Zhan, Shandong (CN); Mengjin Cai, Shandong (CN)

(73) Assignee: Goertek, Inc., Weifang (CN)

( * ) Notice: Subject to any disclaimer, the term of this patent is extended or adjusted under 35 U.S.C. 154(b) by 621 days.

(21) Appl. No.: 16/329,193

(22) PCT Filed: Mar. 3, 2017

(86) PCT No.: PCT/CN2017/075590

§ 371 (c)(1),
(2) Date: Feb. 27, 2019

(87) PCT Pub. No.: WO2018/040528

PCT Pub. Date: Mar. 8, 2018

(65) Prior Publication Data

US 2019/0230439 A1 Jul. 25, 2019

(30) Foreign Application Priority Data

Aug. 31, 2016 (CN) ..... 201610784827.5

(51) Int. Cl.
*H04R 7/00* (2006.01)
*H04R 19/00* (2006.01)
(Continued)

(52) U.S. Cl.
CPC ..... *H04R 7/00* (2013.01); *H04R 19/005* (2013.01); *H04R 7/04* (2013.01); *H04R 7/16* (2013.01); *H04R 2201/003* (2013.01)

(58) Field of Classification Search
CPC ..... H04R 7/08
See application file for complete search history.

(56) References Cited

U.S. PATENT DOCUMENTS 2,935,248 A * 5/1960 Gerteis ..... F04B 39/1073 417/564
8,065,919 B2 11/2011 Takeuchi
(Continued)

FOREIGN PATENT DOCUMENTS

CN 204316746 U 5/2015
CN 204425633 * 6/2015 ..... H04R 9/02
(Continued)

OTHER PUBLICATIONS

International Search Report and Written Opinion of application No. PCT/CN2017/075590, dated May 22, 2017 (13 pages with English Translation).

*Primary Examiner* — Angelica M McKinney
(74) *Attorney, Agent, or Firm* — Patent Law Works LLP

(57) ABSTRACT

The present invention discloses a vibration diaphragm in an MEMS microphone, and an MEMS microphone. The vibration diaphragm comprises a vibration diaphragm body and at least one pressure relief device defined by gaps in the vibration diaphragm body, wherein the gaps comprise at least two sections of circular arc-shaped gaps sequentially connected together. The two adjacent sections of circular arc-shaped gaps are in an S shape as a whole and centrosymmetrical with respect to a connected position thereof. The pressure relief device comprises at least two valve clacks formed by at least two sections of adjacent circular arc-shaped gaps and neck portions connected to the valve clacks and the vibration diaphragm body and of a constraint shape.

10 Claims, 6 Drawing Sheets

(51) Int. Cl.
*H04R 7/16* (2006.01)
*H04R 7/04* (2006.01)

(56) References Cited

U.S. PATENT DOCUMENTS

| | | | | |
|---|---|---|---|---|
| 10,375,482 | B2 * | 8/2019 | Inoue | B81B 7/0029 |
| 10,715,924 | B2 * | 7/2020 | Cheng | H04R 19/005 |
| 2013/0223023 | A1 * | 8/2013 | Dehe | B81B 7/0029<br>361/752 |
| 2014/0084396 | A1 * | 3/2014 | Jenkins | H04R 1/222<br>257/419 |
| 2015/0078593 | A1 * | 3/2015 | Uchida | H04R 19/005<br>381/191 |

FOREIGN PATENT DOCUMENTS

| | | | | |
|---|---|---|---|---|
| CN | 204425633 | U | | 6/2015 |
| CN | 105357617 | A | | 2/2016 |
| CN | 106375912 | A | | 2/2017 |
| CN | 206365042 | U | * | 7/2017 |
| CN | 206908856 | U | * | 1/2018 |
| CN | 207124764 | U | * | 3/2018 |
| JP | 2011055087 | A | | 3/2011 |

* cited by examiner

VIBRATION DIAPHRAGM IN MEMS MICROPHONE AND MEMS MICROPHONE

CROSS-REFERENCE TO RELATED APPLICATIONS

This application is a National Stage of International Application No. PCT/CN2017/075590, filed on Mar. 3, 2017, which claims priority to Chinese Patent Application No. 201610784827.5, filed on Aug. 31, 2016, both of which are hereby incorporated by reference in their entireties.

TECHNICAL FIELD

The present invention relates to a vibration diaphragm for sound generation, and more particularly to a vibration diaphragm in an MEMS microphone; and the present invention further relates to an MEMS microphone.

BACKGROUND

The MEMS (micro electro-mechanical systems) microphone is a microphone manufactured based on an MEMS technology. A vibration diaphragms and a back pole plate are important components in the MEMS microphone. The vibration diaphragm and the back pole plate form a capacitor and are integrated on a silicon wafer to realize acoustic-electrical conversion. In the traditional manufacturing process for the vibration diaphragm, an oxide layer is manufactured on a silicon substrate, and then a layer of a vibration diaphragm is manufactured on the oxide layer by depositing. After doping and tempering, the desired pattern is etched, and the vibration diaphragm is fixed to the substrate by rivet points at the edges thereof. Of course, electrodes are also required to be led from the vibration diaphragm, and the distance between the vibration diaphragm and the back pole plate is changed by the vibration of the vibration diaphragm, thereby converting a sound signal into an electrical signal.

When the MEMS microphone is subjected to mechanical shock, blowing, or falling, an MEMS chip therein will be subjected to a relatively large sound pressure shock, which often causes excessive pressure to the vibration diaphragm to generate rupture and damage, thereby causing the failure of the entire microphone.

SUMMARY

An object of the present invention is to provide a novel technical solution of a vibration diaphragm in an MEMS microphone.

According to a first aspect of the present invention, there is provided a vibration diaphragm in an MEMS microphone, which comprises: a vibration diaphragm body and at least one pressure relief device defined by gaps in the vibration diaphragm body, wherein the gaps comprise at least two sections of circular arc-shaped gaps sequentially connected together, the two adjacent sections of circular arc-shaped gaps are in an S shape as a whole and centrosymmetrical with respect to a connected position thereof, and the pressure relief device comprises at least two valve clacks formed by at least two sections of adjacent circular arc-shaped gaps and neck portions connected to the valve clacks and the vibration diaphragm body and of a constraint shape.

Optionally, two sides of the neck portion are symmetrical about an axis thereof.

Optionally, the circular arc-shaped gaps are provided as two sections, which are respectively referred to as a first gap and a second gap. The first gap and the second gap jointly form a first valve clack and a second valve clack on the vibration diaphragm body, as well as a first neck portion connected to the first valve clack and the vibration diaphragm body and a second neck portion connected to the second valve clack and the vibration diaphragm body.

Optionally, a tightened first opening is formed between the position where the first gap and the second gap are connected and a free end of the first gap, and the first neck portion is formed at the position of the first opening. A tightened second opening is formed between the position where the first gap and the second gap are connected and a free end of the second gap, and the second neck portion is formed at the position of the second opening.

Optionally, the circular arc-shaped gaps are provided as three sections, which are respectively referred to as a first gap, a second gap, and a third gap and are sequentially connected together. The first gap, the second gap, and the third gap jointly form a first valve clack, a second valve clack, and a third valve clack on the vibration diaphragm body, as well as a first neck portion connected to the first valve clack and the vibration diaphragm body, a second neck portion connected to the second valve clack and the vibration diaphragm body, and a third neck portion connected to the third valve clack and the vibration diaphragm body.

Optionally, a tightened first opening is formed between the position where the first gap and the second gap are connected and a free end of the first gap, and the first neck portion is formed at the position of the first opening. A tightened second opening is formed between the position where the first gap and the second gap are connected and the position where the second gap and the third gap are connected, and the second neck portion is formed at the position of the second opening. A tightened third opening is formed between the position where the second gap and the third gap are connected and a free end of the third gap, and the third neck portion is formed at the position of the third opening.

Optionally, one pressure relief device is provided in a central region of the vibration diaphragm body.

Optionally, a plurality of pressure relief devices is provided, and the plurality of pressure relief devices is evenly distributed in a circumferential direction of the vibration diaphragm body.

According to another aspect of the present invention, there is also provided an MEMS microphone, comprising the above vibration diaphragm.

Optionally, the gaps are formed by etching when the vibration diaphragm body is formed by depositing.

According to the vibration diaphragm of the present invention, in the initial state, the valve clacks are flush with the entire vibration diaphragm body, that is, the valve clacks are in a closed state. When subjected to a relatively high sound pressure caused by, for example, mechanical shock, blowing or falling, the at least two valve clacks symmetrical in structure can warp upwards or downwards by taking their respective neck portions as pivots. Therefore, an effective pressure relief path is formed, and the aim of pressure relief is achieved. From one perspective, the vibration diaphragm can bear the high sound pressure or the instantaneous air pressure generated by a falling process, thereby avoiding the damage to the chip. Due to the use of the at least two symmetrical valve clacks, the requirements can be met without large sizes of the valve clacks, thereby ensuring the performance requirements of the vibration diaphragm per se.

The inventors of the invention found in the prior art that when the MEMS microphone is subjected to mechanical shock, blowing, or falling, the MEMS chip therein will be subjected to a relatively large sound pressure shock, which often causes excessive pressure to the vibration diaphragm to generate rupture and damage, thereby causing the failure of the entire microphone. Therefore, the technical task to be achieved or the technical problem to be solved by the present invention is never conceived or expected by those skilled in the art and thus is a novel technical solution.

Other features and advantages of the present invention will become apparent through the detailed descriptions of the exemplary embodiments of the present invention with reference to the drawings.

BRIEF DESCRIPTION OF THE DRAWINGS

The drawings that constitute a part of the description show the embodiments of the present invention and are intended to explain the principle of the present invention together with the descriptions thereof.

DETAILED DESCRIPTION

Now, various exemplary embodiments of the present invention will be described in detail with reference to the drawings. It should be noted that, unless specified otherwise, the relative arrangements of the members and steps, the mathematical formulas and numerical values described in these embodiments do not restrict the scope of the present invention.

The following descriptions for at least one embodiment are actually descriptive only, and shall not be intended to limit the invention and any application or use thereof.

The techniques and devices well known to those skilled in the related arts may not be discussed in detail. However, where applicable, such techniques and devices should be deemed as a part of the description.

Any specific value shown herein and in all the examples should be interpreted as exemplary only rather than restrictive. Therefore, other examples of the exemplary embodiments may include different values.

It should be noted that similar signs and letters in the following drawings represent similar items. Therefore, once defined in one drawing, an item may not be further discussed in the followed drawings.

Figure 1:
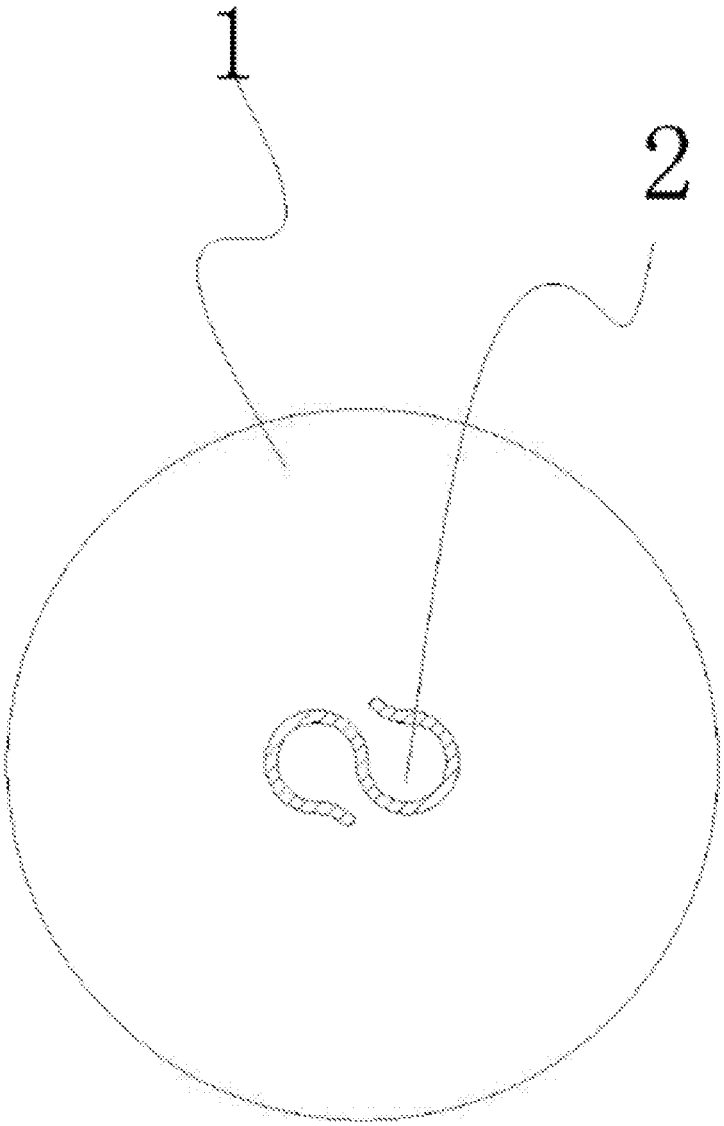
FIG. 1 is a structural schematic view of a vibration diaphragm according to the present invention.
Figure 2:
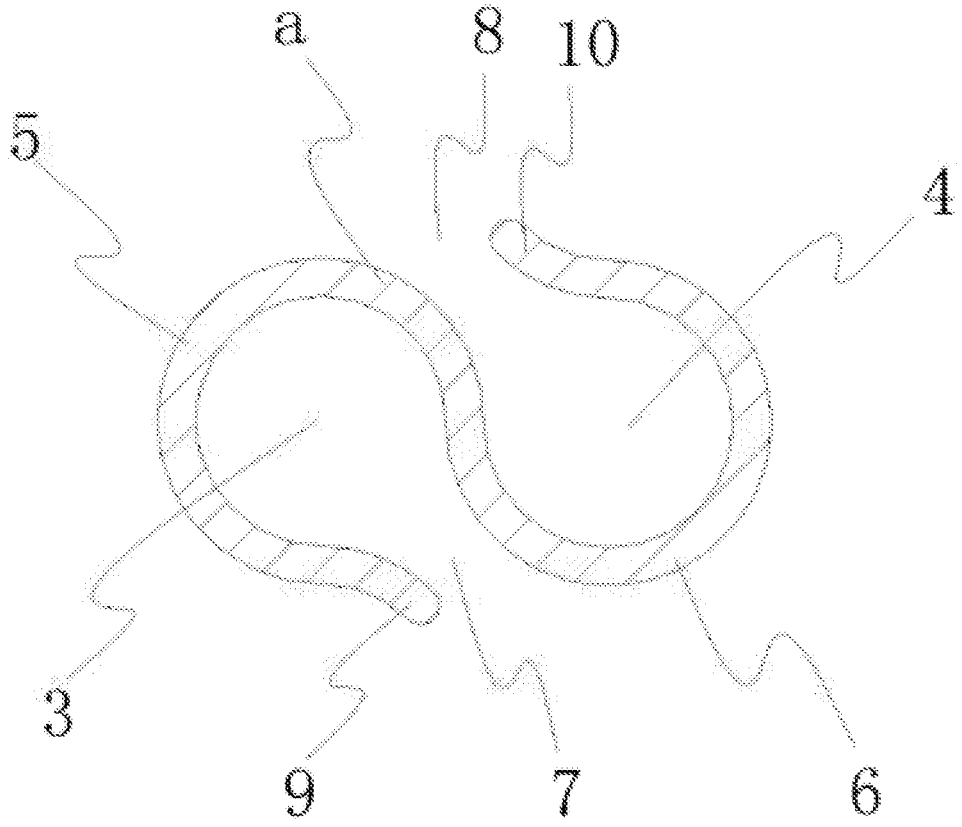
FIG. 2 is a structural schematic view of gaps in FIG. 1.

Referring to FIG. 1 and FIG. 2, the present invention provides a vibration diaphragm in an MEMS microphone, which comprises a diaphragm body 1 and at least one pressure relief device 2 defined by gaps a in the vibration diaphragm body 1. The gaps a are provided in a predetermined shape in the vibration diaphragm body 1, and the pressure relief device 2 is formed on the vibration diaphragm body 1 by the gaps a.

The gaps a comprise at least two sections of circular arc-shaped gaps sequentially connected together. These circular arc-shaped gaps are sequentially connected together. The two adjacent sections of circular arc-shaped gaps are in an S shape as a whole and centrosymmetrical with respect to a connected position thereof. The pressure relief device 2 comprises at least two valve clacks defined by at least two sections of adjacent circular arc-shaped gaps and neck portions connected to the valve clacks and the vibration diaphragm body 1 and of a constraint shape. The neck portions are in the constraint shape with respect to the valve clacks, such that the valve clacks can warp upwards or downwards by taking the neck portions as pivots to form an air path.

According to the vibration diaphragm of the present invention, in the initial state, the valve clacks are flush with the entire vibration diaphragm body, that is, the valve clacks are in a closed state. When subjected to a relatively high sound pressure caused by, for example, mechanical shock, blowing or falling, the at least two valve clacks symmetrical in structure may warp upwards or downwards by taking their respective neck portions as pivots. Therefore, an effective pressure relief path is formed, and the aim of pressure relief is achieved. From one perspective, the vibration diaphragm can bear the high sound pressure or the instantaneous air pressure generated by a falling process, thereby avoiding the damage to the chip. Due to the use of the at least two symmetrical valve clacks, the requirements can be met without large sizes of the valve clacks, thereby ensuring the performance requirements of the vibration diaphragm per se.

Figure 6:
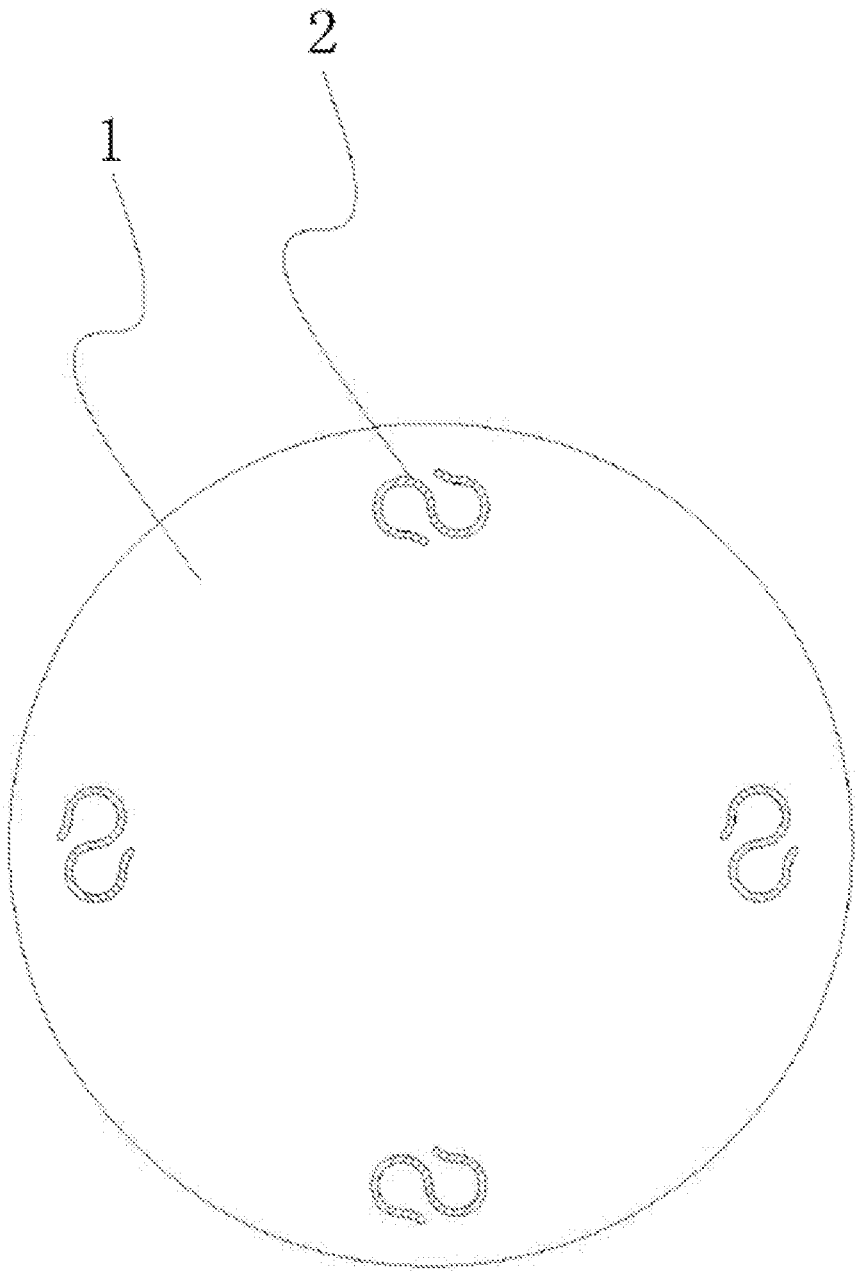
FIG. 6 is a schematic view of another embodiment of the vibration diaphragm according to the present invention.

One pressure relief device 2 according to the present invention may be provided in a central region of the vibration diaphragm body 1, referring to FIG. 1. A plurality of pressure relief devices 2 may also be provided evenly in the circumferential direction of the vibration diaphragm body 1, referring to FIG. 6.

Embodiment 1

Two, three or more circular arc-shaped gaps according to the present invention may be provided. In a specific embodiment of the present invention, the circular arc-shaped gaps are provided as two sections, which are respectively referred to as a first gap 5 and a second gap 6. Referring to FIG. 2, the first gap 5 and the second gap 6 respectively have a non-closed circular arc shape, and the two gaps have the same size and shape, are in the S shape as a whole after being connected together, and are centrosymmetrical with respect to a connected position thereof. The first gap 5 and the second gap 6 according to the present invention may be simultaneously formed. For example, the first gap 5 and the second gap 6 according to the present invention may be formed by etching the vibration diaphragm body 1.

Since the first gap 5 and the second gap 6 are provided in the vibration diaphragm body 1, the first gap 5 and the second gap 6 jointly form a first valve clack 3 and a second valve clack 4 on the vibration diaphragm body 1, as well as a first neck portion 7 connected to the first valve clack 3 and the vibration diaphragm body 1, and a second neck portion 8 connected to the second valve clack 4 and the vibration diaphragm body 1, referring to FIG. 2. Specifically, due to the curved shape, the first gap 5 forms the first valve clack 3 on the vibration diaphragm body 1. A tightened first opening is formed between the position where the first gap 5 and the second gap 6 are connected and a free end 9 of the first gap 5, and the first neck portion 7 is formed at the position of the first opening. Preferably, the shape of the connected position between the first gap 5 and the second gap 6 and the shape of the free end 9 of the first gap 5 are symmetrically distributed along an axis therebetween. Therefore, two side edges of the first neck portion 7 are symmetrical about the axis of the first neck portion 7.

Based on the same principle, due to the curved shape, the second gap 6 forms the second valve clack 4 on the vibration diaphragm body 1. A tightened second opening is formed between the position where the second gap 5 and the second gap 6 are connected and a free end 10 of the second gap 6, and the second neck portion 8 is formed at the position of the second opening. Preferably, the shape of the connected position between the first gap 5 and the second gap 6 and the shape of the free end 10 of the second gap 6 are symmetrically distributed along an axis therebetween. Therefore, two side edges of the second neck portion 8 are symmetrical about the axis of the second neck portion 8.

Figure 3:
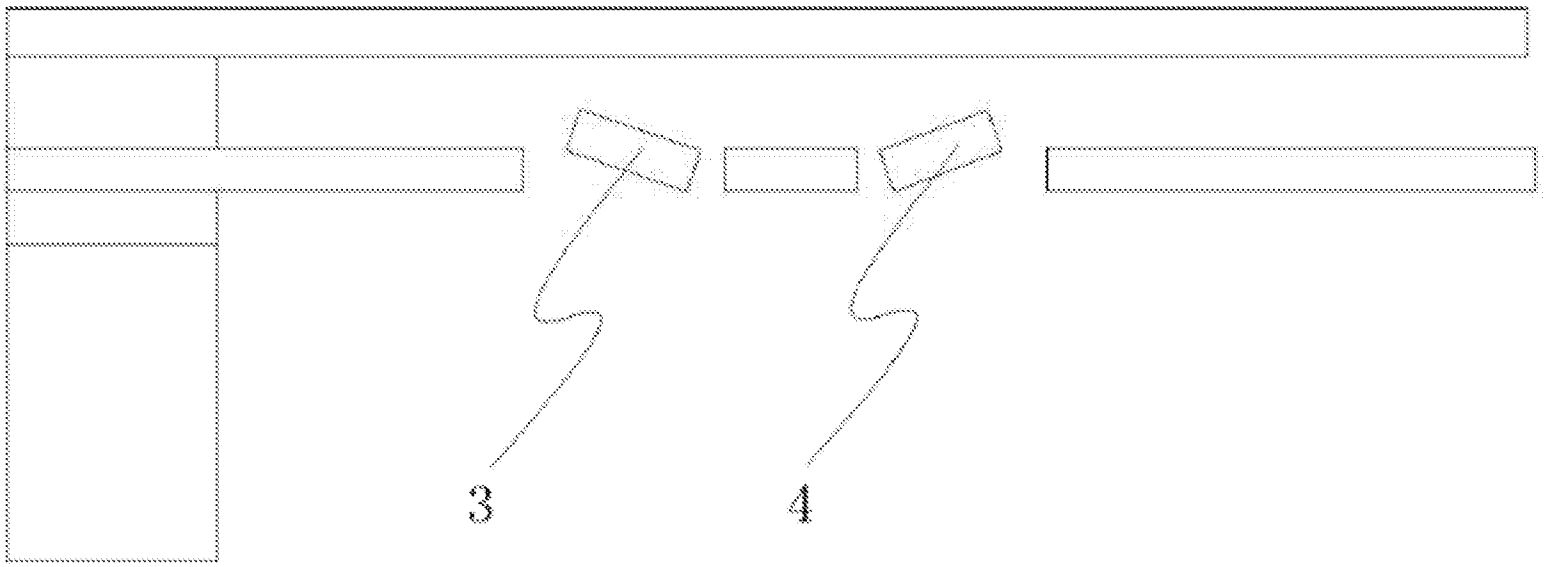
FIG. 3 is a schematic view when the valve clacks are in an open state in FIG. 1.

When the vibration diaphragm body 1 is subjected to a relatively large air pressure shock, the first valve clack 3 and the second valve clack 4 may wrap upward or downward with the first neck portion 7 and the second neck portion 8 as pivots respectively, thereby opening the pressure relief passage where the air passes through the vibration diaphragm body 1, referring to FIG. 3. The first neck portion 7 and the second neck portion 8 adopt a symmetrical structure, so that when the first valve clack and the second valve clack are opened under a relatively large pressure, the problem of warpage deformation caused by the stress of the vibration diaphragm can be avoided, thereby ensuring the flatness of the vibration diaphragm body 1.

Embodiment 2

Figure 4:
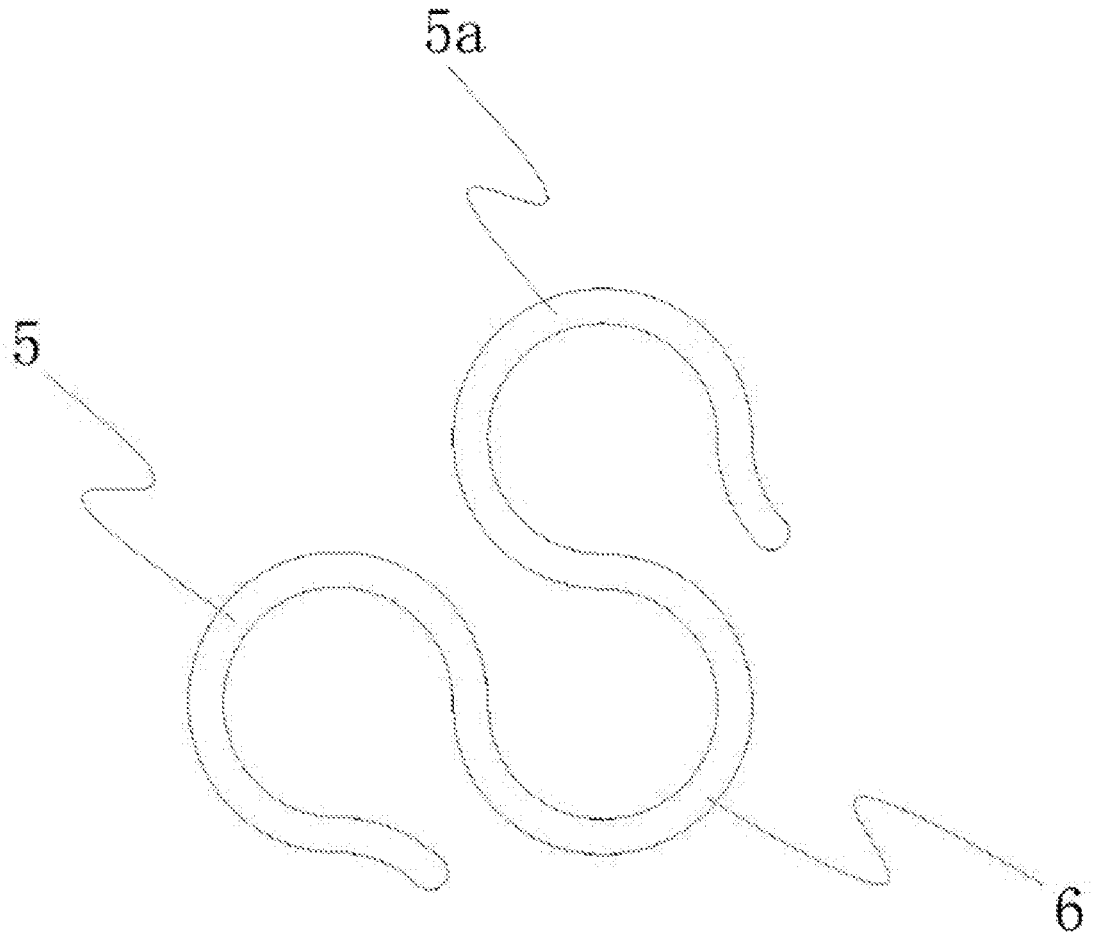
FIG. 4 is a schematic view of a second embodiment of the gaps according to the present invention.

In the present embodiment, in order to increase the pressure relief amount of the pressure relief device 2, the circular arc-shaped gaps are provided as three sections, which are respectively referred to as a first gap 5, a second gap 6, and a third gap 5*a* and are sequentially connected together, referring to FIG. 4. Based on the similar principle as Embodiment 1, the first gap 5, the second gap 6, and the third gap 5*a* jointly form a first valve clack, a second valve clack, and a third valve clack on the vibration diaphragm body 1, as well as a first neck portion connected to the first valve clack and the vibration diaphragm body, a second neck portion connected to the second valve clack and the vibration diaphragm body, and a third neck portion connected to the third valve clack and the vibration diaphragm body.

The first gap 5, the second gap 6, and the third gap 5*a* are respectively in a non-closed circular arc shape, and the three gaps have the same size and shape. Therefore, after the three gaps are sequentially connected together, two adjacent gaps are in an S shape as a whole and are centrosymmetrical with respect to the connected position thereof. The first gap 5, the second gap 6, and the third gap 5*a* according to the present invention may be simultaneously formed. For example, the first gap 5, the second gap 6, and the third gap 5*a* according to the present invention may be formed by etching the vibration diaphragm body 1.

Due to the curved shape, the first gap 5 forms the first valve clack on the vibration diaphragm body 1. A tightened first opening is formed between the position where the first gap 5 and the second gap 6 are connected and a free end of the first gap 5, and the first neck portion is formed at the position of the first opening. Preferably, the shape of the connected position between the first gap 5 and the second gap 6 and the shape of the free end of the first gap 5 are symmetrically distributed along an axis therebetween. Therefore, two side edges of the first neck portion are symmetrical about the axis of the first neck portion.

Due to the curved shape, the second gap 6 forms the second valve clack on the vibration diaphragm body 1. A tightened second opening is formed between the position where the second gap 5 and the second gap 6 are connected and the position where the second gap 6 and the third gap 5*a* are connected, and the second neck portion is formed at the position of the second opening. Preferably, the shape of the connected position between the first gap 5 and the second gap 6 and the shape of the position where the second gap 6 and the third gap 5*a* are connected are symmetrically distributed along an axis therebetween. Therefore, two side edges of the second neck portion are symmetrical about the axis of the second neck portion.

Due to the curved shape, the third gap 5*a* forms the third valve clack on the vibration diaphragm body 1. A tightened third opening is formed between the position where the second gap 6 and the third gap 5*a* are connected and a free end of the third gap 5*a*, and the third neck portion is formed at the position of the third opening. Preferably, the shape of the connected position between the second gap 6 and the third cap 5*a* and the shape of the free end of the third gap 5*a* are symmetrically distributed along an axis therebetween. Therefore, two side edges of the third neck portion are symmetrical about the axis of the third neck portion.

Embodiment 3

Figure 5:
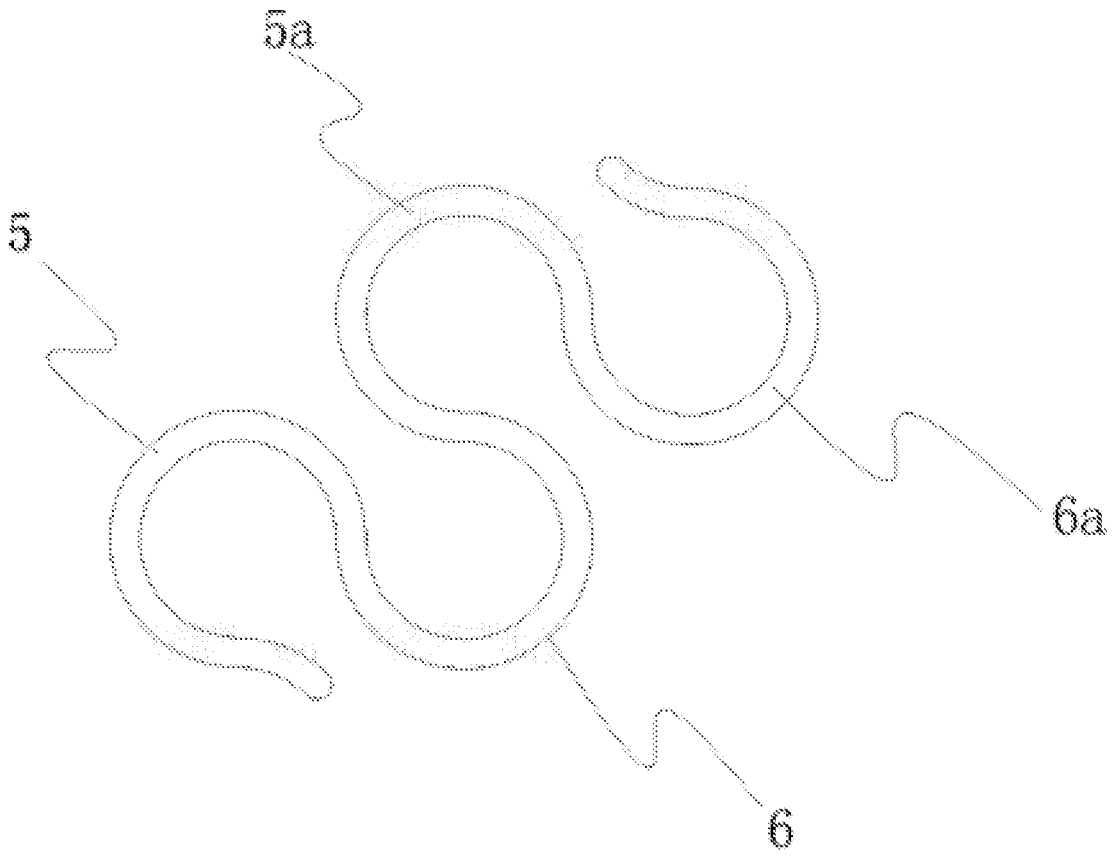
FIG. 5 is a schematic view of a third embodiment of the gaps according to the present invention.

In the present embodiment, the circular arc-shaped gaps are provided as four sections, which are respectively referred to as a first gap 5, a second gap 6, a third gap 5*a*, and a fourth gap 6*a* and are sequentially connected together, referring to FIG. 5. The four gaps jointly form a first valve clack, a second valve clack, a third valve clack, and a fourth valve clack on the vibration diaphragm body 1, as well as a first neck portion, a second neck portion, a third neck portion and a fourth neck portion which are connected to the first valve clack, the second valve clack, the third valve clack and the fourth valve clack and the vibration diaphragm body 1 respectively. The embodiment is similar to the structure of Embodiment 3 and will not be specifically described herein.

The vibration diaphragm according to the present invention can be applied to the MEMS microphone so as to improve the sound pressure resistance of the MEMS microphone. For this purpose, the present invention also provides an MEMS microphone, comprising a substrate, a back pole, and the above vibration diaphragm forming a flat capacitor structure with the back pole. Such structural form of the back pole and the vibration diaphragm is general common knowledge of those skilled in the art. When the MEMS microphone is manufactured, the back pole and the vibration diaphragm are formed by deposition and etching. The above gaps may be formed by etching when the vibration diaphragm is formed by depositing.

Although specific embodiments of the present invention are described in detail through some examples, those skilled in the art shall understand that the above examples are illustrative only and are not intended to limit the scope of the present invention, that modifications can be made to the above embodiments without departing from the scope and spirit of the present invention, and that the scope of the present invention is defined by the appended claims.

The invention claimed is:

1. A vibration diaphragm in an MEMS microphone, comprising:

a vibration diaphragm body and at least one pressure relief device defined by gaps in the vibration diaphragm body, wherein the gaps comprise at least two adjacent sections of circular arc-shaped gaps sequentially connected together, the at least two adjacent sections of circular arc-shaped gaps are in an S shape as a whole and are centrosymmetrical with respect to a connected position thereof, and the pressure relief device comprises at least two valve clacks formed by the at least two adjacent sections of circular arc-shaped gaps and respective neck portion connected to respective valve clacks and the vibration diaphragm body and of a constraint shape, wherein a width of each valve clack increases from the neck portion along an axis of the neck portion.

2. The vibration diaphragm according to claim 1, wherein two sides of the neck portion are symmetrical about the axis thereof.

3. The vibration diaphragm according to claim 1, wherein the circular arc-shaped gaps are provided as two sections, which are respectively referred to as a first gap and a second gap, wherein the first gap and the second gap jointly form a first valve clack and a second valve clack on the vibration diaphragm body, as well as a first neck portion connected to the first valve clack and the vibration diaphragm body and a second neck portion connected to the second valve clack and the vibration diaphragm body.

4. The vibration diaphragm according to claim 3, wherein a tightened first opening is formed between the position where the first gap and the second gap are connected and a free end of the first gap, and the first neck portion is formed at the position of the first opening; and a tightened second opening is formed between the position where the first gap and the second gap are connected and a free end of the second gap, and the second neck portion is formed at the position of the second opening.

5. The vibration diaphragm according to claim 1, wherein the circular arc-shaped gaps are provided as three sections, which are respectively referred to as a first gap, a second gap, and a third gap and are sequentially connected together, wherein the first gap, the second gap, and the third gap jointly form a first valve clack, a second valve clack, and a third valve clack on the vibration diaphragm body, as well as a first neck portion connected to the first valve clack and the vibration diaphragm body, a second neck portion connected to the second valve clack and the vibration diaphragm body, and a third neck portion connected to the third valve clack and the vibration diaphragm body.

6. The vibration diaphragm according to claim 5, wherein a tightened first opening is formed between the position where the first gap and the second gap are connected and a free end of the first gap, and the first neck portion is formed at the position of the first opening;

a tightened second opening is formed between the position where the first gap and the second gap are connected and the position where the second gap and the third gap are connected, and the second neck portion is formed at the position of the second opening; and a tightened third opening is formed between the position where the second gap and the third gap are connected and a free end of the third gap, and the third neck portion is formed at the position of the third opening.

7. The vibration diaphragm according to claim 1, wherein one pressure relief device is provided in a central region of the vibration diaphragm body.

8. The vibration diaphragm according to claim 1, wherein a plurality of pressure relief devices is provided, and the plurality of pressure relief devices is evenly distributed in a circumferential direction of the vibration diaphragm body.

9. An MEMS microphone, comprising the vibration diaphragm according to claim 1.

10. The MEMS microphone according to claim 9, wherein the gaps are formed by etching when the vibration diaphragm body is formed by depositing.

* * * * *